US007161570B2

(12) United States Patent
Waterman

(10) Patent No.: US 7,161,570 B2
(45) Date of Patent: Jan. 9, 2007

(54) DISPLAY DRIVER ARCHITECTURE FOR A LIQUID CRYSTAL DISPLAY AND METHOD THEREFORE

(75) Inventor: John Karl Waterman, Mesa, AZ (US)

(73) Assignee: Brillian Corporation, Tempe, AZ (US)

( * ) Notice: Subject to any disclaimer, the term of this patent is extended or adjusted under 35 U.S.C. 154(b) by 510 days.

(21) Appl. No.: 10/644,476

(22) Filed: Aug. 19, 2003

(65) Prior Publication Data

US 2005/0052379 A1 Mar. 10, 2005

(51) Int. Cl.
*G09G 3/36* (2006.01)

(52) U.S. Cl. ..... 345/88; 345/96

(58) Field of Classification Search ..... 345/88, 345/93, 96, 103
See application file for complete search history.

(56) References Cited

U.S. PATENT DOCUMENTS

| | | | | |
|---|---|---|---|---|
| 4,368,523 | A * | 1/1983 | Kawate | 365/63 |
| 4,737,782 | A | 4/1988 | Fukuma et al. | 340/765 |
| 5,153,568 | A | 10/1992 | Shaw | 340/703 |
| 5,192,945 | A | 3/1993 | Kusada | 340/784 |
| 5,619,225 | A | 4/1997 | Hashimoto | 345/98 |
| 5,963,200 | A | 10/1999 | Deering et al. | 345/213 |
| 6,538,648 | B1 * | 3/2003 | Koike et al. | 345/213 |
| 6,989,810 | B1 * | 1/2006 | Morita | 345/98 |

FOREIGN PATENT DOCUMENTS

| | | |
|---|---|---|
| EP | 0421428 A2 | 4/1991 |
| JP | 07191631 | 7/1995 |

OTHER PUBLICATIONS

Transmittal of the International Search Report and Written Opinion for PCT/US2004/026784, mailed Dec. 8, 2004.

* cited by examiner

*Primary Examiner*—Richard Hjerpe
*Assistant Examiner*—Ke Xiao
(74) *Attorney, Agent, or Firm*—Baker Botts L.L.P.

(57) ABSTRACT

Methods and apparatus are provided for driving a liquid crystal microdisplay. The apparatus comprises more than one display driver integrated circuit where a liquid crystal microdisplay receives video information from at least two separate and distinct display driver integrated circuits. One of the display driver integrated circuits is designated as producing a master clock. The internal clocks of the other display driver integrated circuits are compared to the master clock and adjusted to reduce the phase difference to a delay that does not produce visible artifacts on the microdisplay. The frame polarity is compared to be the same from each integrated circuit driving the microdisplay before outputting video information. A frame synchronization signal is also generated from each display driver integrated circuit to ensure that they are all ready to provide information to the microdisplay.

9 Claims, 5 Drawing Sheets

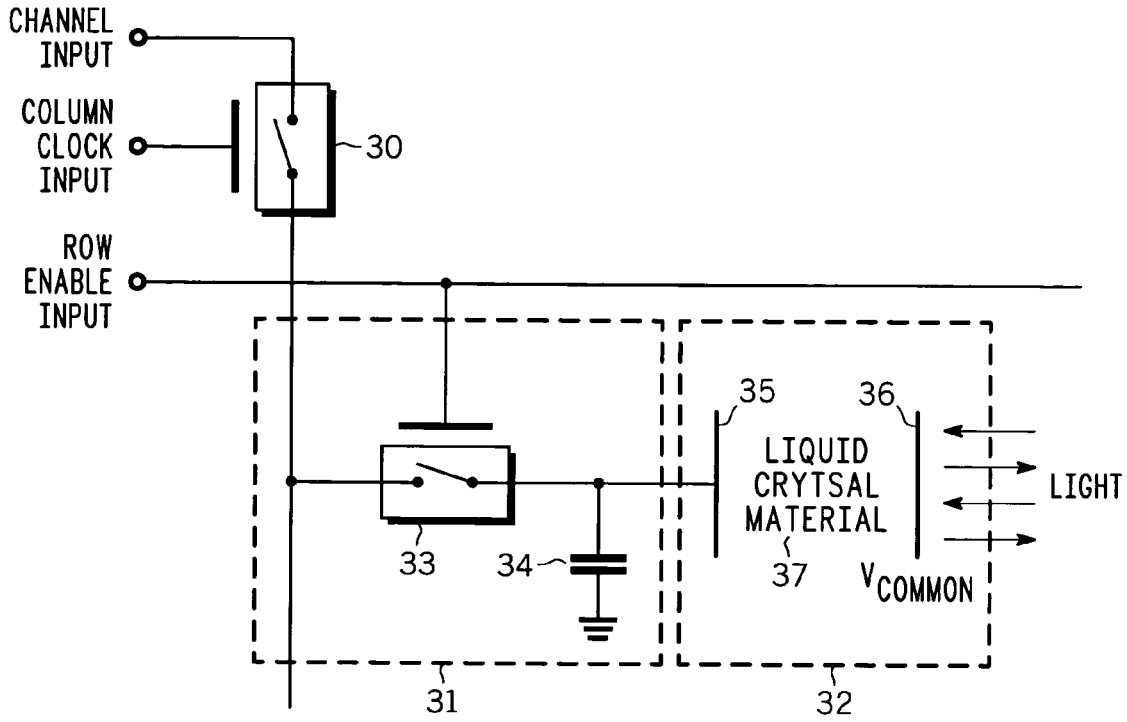
FIG. 3
FIG. 5
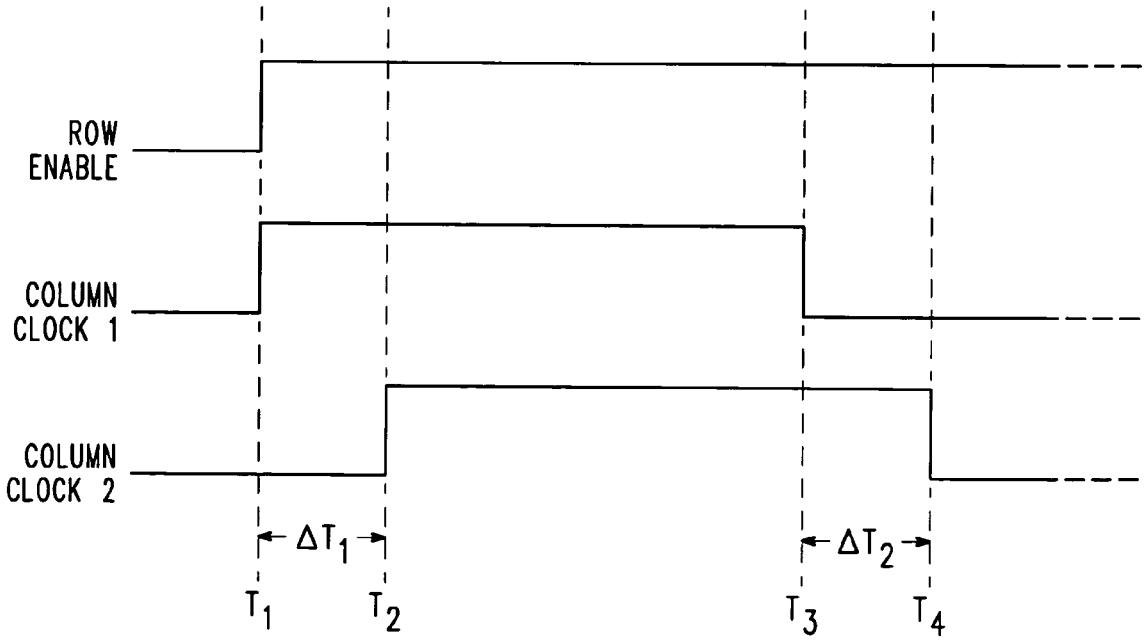

DISPLAY DRIVER ARCHITECTURE FOR A LIQUID CRYSTAL DISPLAY AND METHOD THEREFORE

FIELD OF THE INVENTION

The present invention generally relates to video displays, and more particularly relates to display driver circuit architecture for liquid crystal microdisplays.

BACKGROUND OF THE INVENTION

There are many different types of video display technology being commercialized for a number of different applications. Liquid crystal displays (LCD), digital light processing (DLP), cathode ray tube, and plasma are but a few of the technologies trying to gain prominence in this competitive market. Video displays are now used in almost any application requiring information or data to be shown. One area that has seen enormous growth are applications requiring high resolution video displays. Computer displays, office projectors, and high definition television are some of the areas fueling the development.

Display technology has been advancing at a very rapid pace. A display driver circuit is a critical component of a video display. In general, a display driver circuit receives video information, processes the video information, and provides it in the proper format for the display it is driving. The number of video formats has grown as new display technologies and higher resolution displays are introduced. Display driver circuits are designed to be highly flexible to handle a wide range of formats. For example, VGA (Video Graphics Array), SVGA (Super Video Graphics Array), XGA (Extended Graphics Array), and SXGA (Super Extended Graphics Array) are a few of the widely known video standards that a typical display driver circuit could handle. HDTV, WUXGA, QXGA, and QUXGA are examples of formats for high resolution video displays.

Display driver circuits are designed to be highly flexible to handle a wide range of formats. The higher resolution video display formats are pushing the limits of what can be manufactured using conventional integrated circuit wafer processing. To show the enormity of the problem, a next generation display driver circuit for a pixel based QXUGA high resolution video display will have to provide video information to 7,680,000 pixels, sixty times a second. The size and the complexity may also make the cost of such a chip prohibitive.

Accordingly, it is desirable to have the capability to handle large pixel count displays using display driver integrated circuits that can be manufactured at low cost. In addition, it is desirable to drive these high resolution displays with no visual artifacts. Furthermore, other desirable features and characteristics of the present invention will become apparent from the subsequent detailed description and the appended claims, taken in conjunction with the accompanying drawings and the foregoing technical field and background.

BRIEF SUMMARY OF THE INVENTION

An apparatus is provided to drive a display. The apparatus comprises a first display driver integrated circuit having a first plurality of channels coupled to the display and a second display driver integrated circuit having a second plurality of channels coupled to the display. The first display driver integrated circuit provides control signals to the display to enable the display to receive video information through the first plurality of channels. The second display driver integrated circuit also provides control signals to the display to enable the display to received video information through the second plurality of channels. The control signals from the first and second display driver integrated circuit are phase adjusted to one another to prevent visual artifacts on the display A method is provided for driving a liquid crystal microdisplay. The method comprises the steps of coupling at least one channel from a first display driver integrated circuit to the liquid microdisplay. At least one channel of a second display driver integrated circuit is coupled to the liquid crystal microdisplay. A frame synchronization signal from the first and second display driver integrated circuits is compared. A transfer of video information through the at least one channel of both the first and second display driver integrated circuits is initiated when the frame synchronization signals from the first and second display integrated circuits indicate they are both prepared to transfer.

BRIEF DESCRIPTION OF THE DRAWINGS

The present invention will hereinafter be described in conjunction with the following drawing figures, wherein like numerals denote like elements.

FIG. 3 is a schematic diagram of a switch, storage cell, and a pixel of a liquid crystal microdisplay;

FIG. 5 is a timing diagram corresponding to the schematic diagram of FIG. 4.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Display technology has undergone rapid advances that have led to the commercialization of new systems and the improvement of existing display technologies. The consumer now has more different choices than ever in selecting a display. For example, conventional CRT (cathode ray tube), LCD (liquid crystal display), plasma, DLP (digital light processing), and TFT (thin film transistor) are but a few of the technologies being used to manufacture displays. Each display type has advantages and disadvantages when comparing picture quality, package dimensions, and cost.

Figure 1:
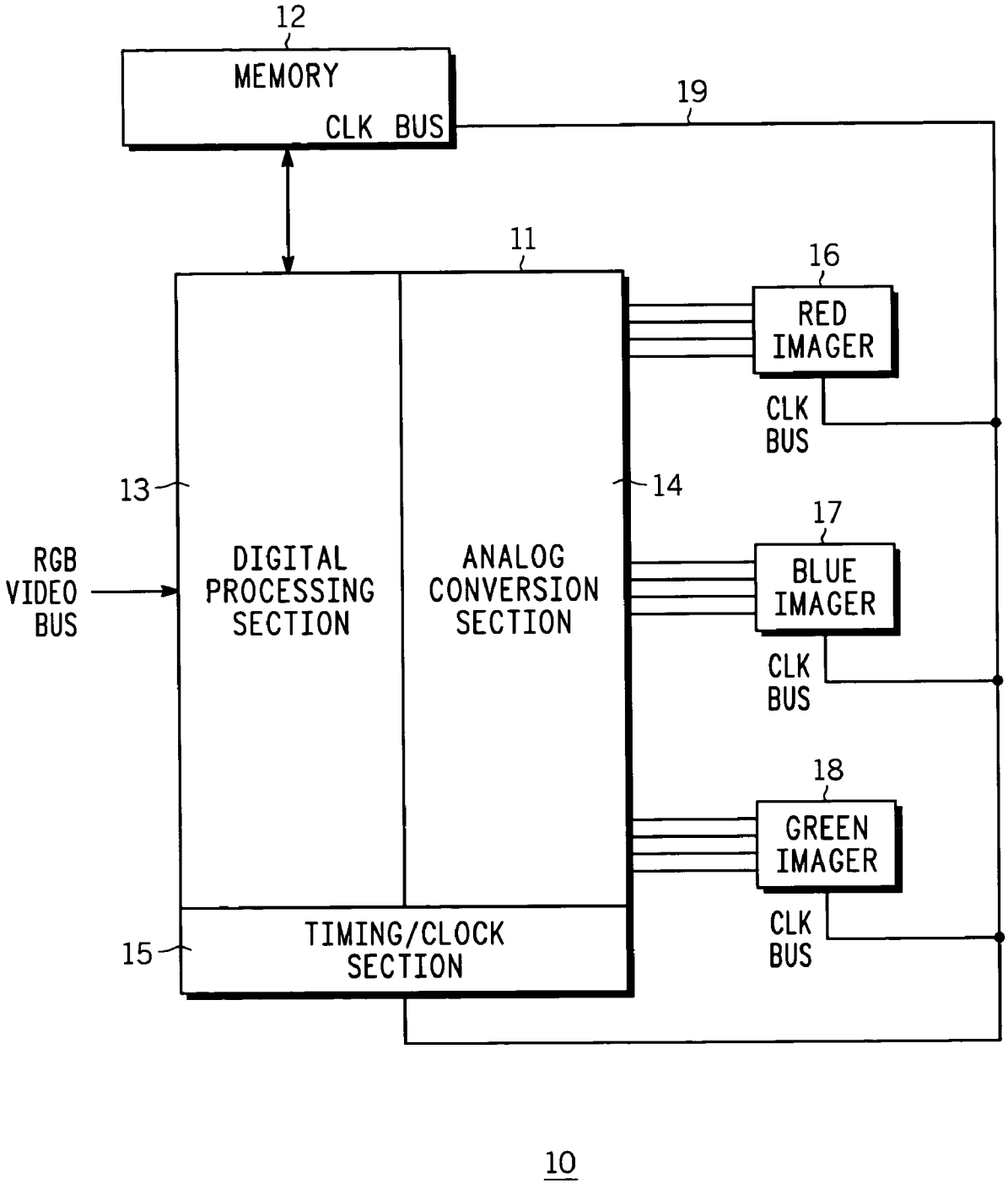
FIG. 1 is a block diagram of a system for driving a display.

FIG. 1 is a block diagram of a system 10 for driving a display. System 10 comprises a display driver integrated circuit 11 and a memory 12. Display driver integrated circuit 11 includes a digital processing section 13, an analog conversion section 14, and a timing/clock section 15. In general, system 10 receives video information, processes the video information, and outputs the video information in a format for the display being driven. The processing of the video information may include manipulation of the data and error correction as required to enhance the image quality of the display.

In an embodiment of system 10, a RGB (Red, Green, Blue) video bus provides color video information to display driver integrated circuit 11. Typically, the color video information is in a digital format. A frame of video information corresponds to an amount of data to create a full screen image on the display. In general, a frame of video information is provided at a rate of 30–60 hertz. The human eye cannot perceive these rapid frame by frame changes on the display, thus appearing as a continuous motion similar to what we see in the real world.

In one embodiment, the video display that is driven by system 10 is a liquid crystal display (LCD). Liquid crystal displays (LCDs) were developed in the 1970s and were quickly adapted for use in small display applications such as calculators and mobile devices. The advantages provided by this technology were ease of manufacturing, low cost, and low power consumption. In general, a liquid crystal display comprises a fixed number of rows and columns of LCD pixels. Each pixel of the display is individually controlled.

A reflective LCD is a pixel based microdisplay that is manufactured using integrated circuit wafer processes. Images created on the microdisplay are made larger through the use of optics. A reflective liquid crystal display operates by applying a voltage across a liquid crystal pixel element. The crystal orientation of the liquid crystal material changes as the applied voltage varies. A mirror, behind the liquid crystal material is used to reflect light that passes through the liquid crystal material back to the viewer. The amount of light reflected back through the display to the viewer is dependent on the crystal orientation of the liquid crystal material. In practice, the reflected light ranges from all light reflected back (appears white to the viewer) to none of the light reflected back (appears black to the viewer). Grey shades between white and black are created by adjusting the voltage on the liquid crystal material to allow some light (but not all) to be reflected back.

Memory 12 stores a frame of color video information. Memory 12 is needed to store the color video information because the color video information has to be output twice for a liquid crystal microdisplay. It is well known that a liquid crystal displays degrade over time if the same polarity voltage is continuously applied to the display. The problem of LCD degradation is mitigated by providing a first frame of video information to the LCD microdisplay having a first polarity. A second frame of video information is then provided to the LCD microdisplay of the opposite polarity but having the same magnitude. A LCD display is sensitive only to voltage magnitude and not voltage polarity. The video information is provided to the display at twice the incoming speed to maintain the video rate. In other words, a frame of identical video information is provided twice but of the opposite voltage polarity to prevent degradation of the liquid crystal display.

For example, assume that a frame of video information is provided to display driver integrated circuit 11 every 16.667 milliseconds (60 hertz) from the RGB video bus. Memory 12 in conjunction with display driver integrated circuit 11 provides a frame of color video information in the first 8.333 milliseconds (120 hertz) to the display and then a frame of color video information of the opposite polarity (but equal magnitude) during the second 8.333 milliseconds. The color video information is being output at twice the rate (120 hertz) but creates an identical image on the display over the 16.667 millisecond period with the long term reliability result of no degradation of the liquid crystal display. This process is known as frame inversion.

Digital processing section 13 of display driver integrated circuit 11 is coupled to the RGB video bus. Typically, the RGB video bus includes clock timing. In an embodiment of system 10, digital processing section 13 decouples the external timing from the RGB video bus with the timing internal to display driver integrated circuit 11. This allows the timing of system 10 to be accurately controlled but does not hinder display driver integrated circuit from receiving video information from the RGB video bus. Timing/clock section 15 provides the master clock and other timing to manage the flow of data throughout system 10 and the display. In general, display driver integrated circuit 11, memory 12, and the display run off of an internally generated master clock and derivative timings from timing/clock section 15. Another function of digital processing section 13 is to manipulate or modify the digital color video information being input. For example, digital processing section 13 provides black synthetic frames when video information is not present or corrupted, provides frame resizing, softens or modifies the image, and aids in optical alignment of the image.

Analog conversion section 14 converts the digital color video information to a corresponding analog voltage that is then provided to the display. Analog conversion section 14 may include a large number of digital to analog converters depending on the requirements of the display. As shown, display driver integrated circuit 11 has twelve channels of output. Each channel provides an analog voltage to the display corresponding to digital color video information provided on the RGB video bus. Similar to digital processing section 13, manipulation of the color video information may be desirable in analog conversion section 14. Of times it is easier to manipulate an analog signal than a digital signal and vice versa. For example, left/right shift, top/bottom shift, and uniformity correction are among the data modifications that can be performed in analog conversion section 14.

In an embodiment of system 10, the display is a liquid crystal microdisplay. Liquid crystal technology has proven ideal for a wide variety of applications. Liquid crystal displays are commonly used for portable and low power display applications. Wireless phones, PDAs, watches, and calculators are but a few of the products incorporating LCDs. Liquid crystal technology has proven adaptable to silicon wafer processing which has enhanced the capability to the point where it is a viable (and often superior) alternative to other high quality display technologies. This is evidenced by the growing use of LCDs for computer displays and big screen high definition televisions.

A liquid crystal microdisplay uses semiconductor wafer processing to efficiently manufacture thousands to millions of liquid crystal pixels. The current state of the art has pixel dimensions of approximately 5–20 microns per side (25–400 square micron pixels). One type of liquid crystal microdisplay is a reflective liquid crystal display which is often called a LCOS (Liquid Crystal On Semiconductor) display. The pixels of a LCOS display are arranged in rows and columns. Each pixel is a liquid crystal element comprising a substrate, a reflective conductive layer (ex. Aluminum or an Aluminum alloy), a layer of liquid crystal material, a transparent conductive layer (ex. Indium-Tin-Oxide (ITO)), and a transparent protective layer (ex. glass).

The reflective liquid crystal microdisplay operates by controlling the amount of light reflected to the viewer's eye from each pixel of the display. The composite reflected light from all the pixels of the display form an image. In general, light passes through the protective layer, the transparent conductive layer, and the liquid crystal material to the reflective conductive layer where it is reflected back to the viewer. The amount of light that passes through the liquid crystal material and is reflected back to the viewer is a function of the orientation of the liquid crystal molecules. A difference voltage corresponding to the difference in voltage applied to the reflective conductive layer and the transparent conductive layer creates an electric field across the liquid crystal material that aligns the molecules of the liquid crystal material. The liquid crystal material is sensitive only to the magnitude of the differential voltage and not the polarity. Each pixel is individually controllable to allow a range of light to be reflected back to the viewer from white (all light reflected back) to black (no light is reflected back). Variations between white and black are known as grey shades.

In an embodiment of the display, a red imager 16, a blue imager 17, and a green imager 18 combine to create a color image. For example, an imager is a liquid crystal microdisplay. In general, by combining red, green, and blue colored light it is possible to create a wide palette of colors suitable for a high quality display. This display type is commercially available and often referred to as a cube system because of the use of prisms which are placed in a cube configuration. A lamp (not shown) provides light that is split into 3 beams by prisms (not shown) and respectively directed at red imager 16, blue imager 17, and green imager 18. A red, green, and blue color filter (not shown) is respectively placed in front of red imager 16, blue imager 17, and green imager 18 to apply the appropriate light to each imager. Red imager 16, blue imager 17, and green imager 18 receives a separate frame of video information from display driver integrated circuit 11. Red, green, and blue light reflected respectively from red imager 16, blue imager 17, and green imager 18 is recombined to form a final color image. Optics are used to project the final color image to a display surface.

It should be noted that there are many different methodologies to create a display utilizing a pixel based liquid crystal imager. An alternate method for adding color to a LCOS display utilizes a color wheel and optics. A color wheel is a mechanical rotating device that has red, green, blue, transmissive panels. A light source provides light to the color wheel which is spinning at a predetermine rate. Light passes through the color wheel (red, green, blue, or yellow) to the LCOS imager which is then reflected through optics to form an image on a screen. The speed at which the color wheel spins is synchronized such that color light transmitted through the color wheel is applied to the corresponding color video information applied to the LCOS display (ex. red light/red video information). The advantage of this method is that a single LCOS imager is required. This approach utilizes the fact that the human eye will integrate the three discrete color images into a composite color image. Each color image is being projected at approximately three times the normal frame rate.

Another display methodology utilizes color dots. Similar, to the single imager approach described hereinabove, the use of color dots relies on the visual perception of the human eye. A transmissive color dye (dots) is applied to each pixel of the liquid crystal microdisplay. A color image is created by arranging the colors in the correct order and varying the signal to each pixel based on the color of the pixel. The image created using this technique is perceived as a full color image. This is also somewhat similar to the way a laptop computer screen works. The common thread in all these different types of displays is a pixel based imager that is manufactured using semiconductor wafer processing and that a frame of red, green, and blue video information is provided to the display to create a color image. The frame of red, green, and blue video information can be provided simultaneously or sequentially depending on the display type.

In general, a frame of color video information is provided to display driver integrated circuit 11 approximately 60 times a second. Display driver integrated circuit 11 stores the frame of color video information, processes the color video information, and converts the digital information to analog voltages for the display. A frame of video information is provided at twice the rate (120 hz) by display driver integrated circuit 11 to provide a non-inverted and inverted frame of equivalent video information to eliminate degradation of the liquid crystal microdisplay. All timings of system 10 are controlled through a clock bus 19 coupled from display driver integrated circuit 11 to memory 12, red imager 16, blue imager 17, and green imager 18. The clock timings provided to clock bus 19 are generated in timing/clock section 15 off of a master clock which ensures all elements are synchronized. As mentioned previously, each imager (red imager 16, blue imager 17, and green imager 18) is an array of liquid crystal pixels that form a reflective liquid crystal microdisplay. As shown in FIG. 1, red imager 16, blue imager 17, and green imager 18 are each coupled to display driver integrated circuit 11 through four channels. Each channel provides an analog voltage signal to be applied to a corresponding imager. Having more than one channel decreases the time needed to provide an analog voltage to each pixel of the imager. Thus, display driver integrated circuit 11 is a twelve channel display driver.

Figure 2:
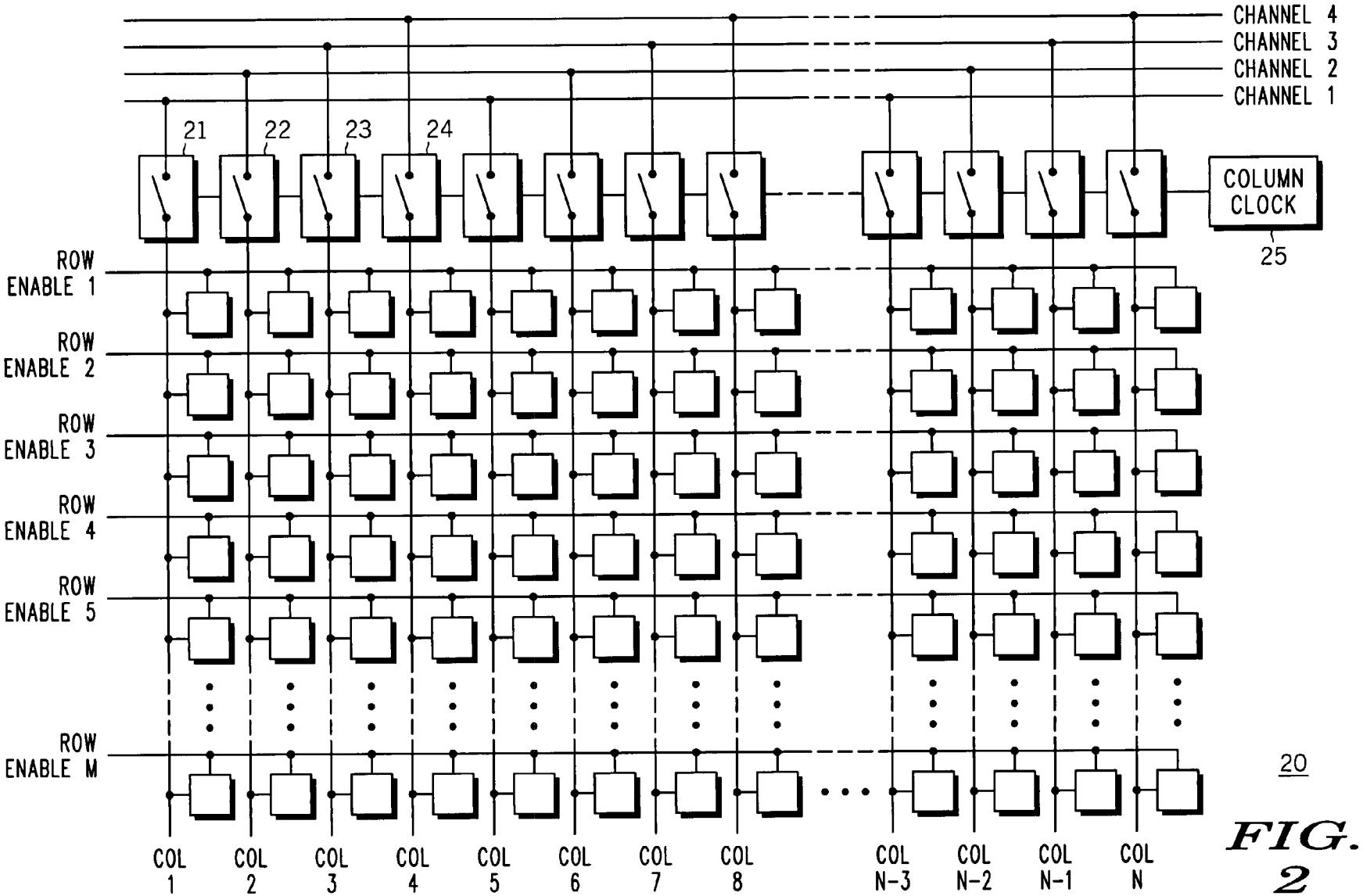
FIG. 2 is a schematic diagram of an array of pixels.

FIG. 2 is a schematic diagram of an array of pixels 20. Array of pixels 20 forms a microdisplay that contains thousands to millions of individually controlled pixel elements. In an embodiment of array of pixels 20, each pixel is a reflective liquid crystal pixel that reflects all, a portion of, or none of the light that is received by the pixel back to the viewer. A pixel is a term that is short for "picture element". Array of pixels 20 is arranged in rows and columns. As shown, array of pixels 20 has N columns and M rows. A specific row and column identifies an individual pixel of array of pixels 20. Ideally, pixels are placed close to one another so they appear connected when viewing an image. In general, the more rows and columns of pixels that are used to form a display, the better the resolution of the display to show fine detail.

A row enable input is coupled to each pixel in a row. For example, row enable 1 couples to each of the N pixels in row 1. A signal applied to the row enable 1 input enables the N pixels in row 1 to receive video information. Typically, only one row of the M rows is enabled at a time. A pixel receives an analog voltage corresponding to the amount of light (grey scale) to be reflected back by the pixel. It is not feasible to input all of the analog voltages to each pixel of a row simultaneously when the number of pixel elements in a row can number in the thousands. Switches are used to sequentially couple the appropriate analog voltage to a corresponding pixel of a row.

As shown, a channel 1, a channel 2, a channel 3, and a channel 4 are used to bring in four analog voltages to four pixels of a row simultaneously. The four channels are for illustration purposes only and the actual number of channels used is an engineering decision that is a function of the application and the desired cost of the display. In general, the speed at which video information can be provided to array of pixels 20 increases with the number of channels provided.

Each column has a switch that is coupled to a single channel of channels 1–4. The other side of the switch couples to each pixel element in the column. For example, column 1 has a switch 21 having an input coupled to channel 1 and an output coupled to the M pixels of column 1. Closing switch 1 couples channel 1 to each of the M pixels of column 1. Column 2 has a switch 22 input coupled to channel 2 and an output coupled to each of the M pixels of column 2. Column 3 has a switch 23 having an input coupled to channel 3 and an output coupled to each of the M pixels of column 3. Similarly, column 4 has a switch 24 having an input coupled to channel 4 and an output coupled to each of the M pixels of column 4. The pattern is repeated for all N switches where blocks of four switches respectively have inputs coupled to channels 1–4 and outputs to the M pixels of their corresponding columns.

In an embodiment of array of pixels 20, video information is provided sequentially from row 1 to row M, via channels 1–4. Within a row, the pixels receive video information four pixels at a time through channels 1–4. A column clock 25 sequentially enables groups of four switches such that in N/4 column clock cycles all pixels in a row have received their corresponding video information. The row is disabled once all the pixels of a row has received its video information and the next row is enabled for receiving video information. In general, each pixel of array of pixels 20 has at least one storage element for storing an analog voltage. The storage element applies the stored voltage to the pixel while other pixels receive video information coupled through channels 1–4 until all pixels of array of pixels 20 have been written to.

FIG. 3 is a schematic diagram of a switch 30, storage cell 31, and a pixel 32 of a portion of a liquid crystal microdisplay. Typically switch 30 and storage cell 31 are formed using integrated circuit wafer processes with pixel 32. Switch 30 couples an analog voltage to storage cell 31. Switch 30 has a channel input for receiving the analog voltage, a column clock input for enabling and disabling switch 30, and an output. In an embodiment of the liquid crystal microdisplay, switch 30 is a transistor or a transmission gate.

Storage cell 31 stores the analog voltage applied to the channel input when switch 30 is disabled. Storage cell 31 has an input coupled to the output of switch 30 and an output. Storage cell 31 comprises a switch 33 and a capacitor 34. Switch 33 has an input coupled to the input of storage cell 31, a row enable input for enabling and disabling switch 33, and an output coupled to the output of storage cell 31. In an embodiment of the liquid crystal microdisplay, switch 33 is a transistor or a transmission gate. Capacitor 34 stores the analog voltage. Capacitor 34 has a first terminal coupled to the output of storage cell 31 and a second terminal coupled for receiving a power supply voltage (ground).

Pixel 32 is a reflective liquid crystal pixel. Pixel 32 includes a reflective conductive plate 35, a transparent conductive plate 36, and a liquid crystal material 37. The output of storage cell 31 couples to an input of pixel 32. Reflective conductive plate 35 is coupled to the input of pixel 32. Transparent conductive plate 36 is coupled to a reference voltage $V_{common}$. In general, transparent conductive plate 36 is common to all pixels of the liquid crystal microdisplay. Liquid crystal material 37 is placed between transparent conductive plate 36 and reflective conductive plate 35.

Video information corresponding to the analog voltage applied to the channel input is coupled to storage cell 31 when a signal applied to the column clock input enables switch 30 and a signal applied to the row enable input enables switch 33. Capacitor 34 is coupled to the channel input and charges to the analog voltage applied thereto. The signal applied to the column clock input then disables switch 30 decoupling storage cell 31 from the video information applied to the channel input. Typically, the signal applied to the row enable input stays in an enable state until all the pixels in the row have been written to. Capacitor 34 stores the analog voltage and provides it to pixel 32. A differential voltage is created across liquid crystal material 37 that is the difference between the voltage stored on capacitor 34 and the reference voltage $V_{common}$. The orientation of the molecules in liquid crystal material 37 align themselves corresponding the differential voltage. The alignment determines how much light passes through liquid crystal material 37. The amount of light passing through liquid crystal material 37 is reflected back off of reflective conductive plate 35. The light reflected back through pixel 32 ranges from none to all and all grey scales inbetween.

Figure 4:
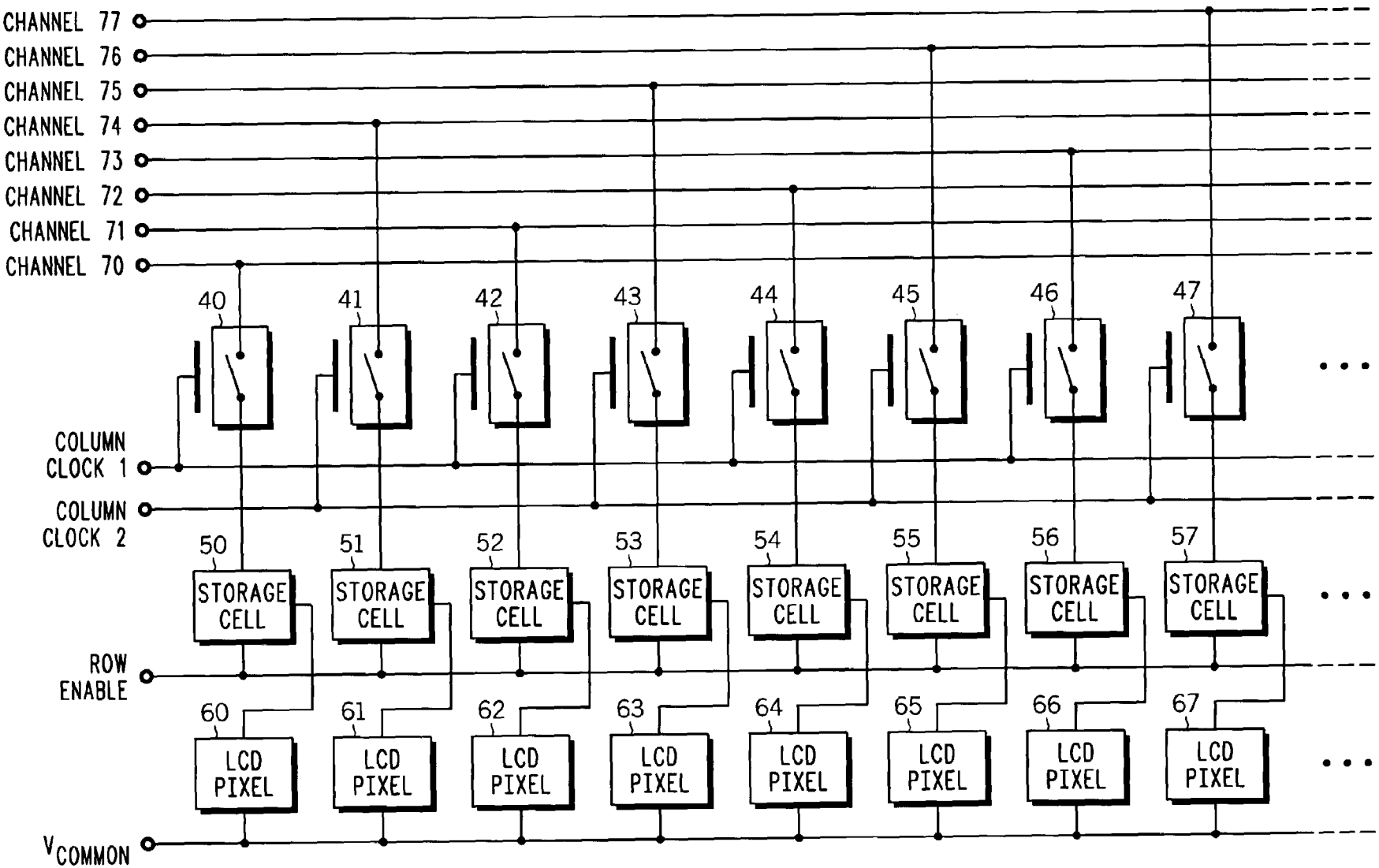
FIG. 4 is a schematic diagram of eight channels being coupled to eight pixels of a liquid crystal microdisplay.

FIG. 4 is a schematic diagram of eight channels being coupled to eight pixels of a liquid crystal microdisplay. The liquid crystal microdisplay will have thousands or millions of pixels (not shown) that will be written to eight pixels at a time. Switches 40–47 receive video information respectively from channels 70–77 and respectively couple the video information on channels 70–77 to storage cells 50–57 when enabled. Switches 40, 42, 44, and 46 are enabled and disabled by a column clock 1. Switches 41, 43, 45, and 47 are enabled and disabled by a column clock 2.

Storage cells 50–57 store video information and provide the stored video information respectively to liquid crystal pixels 60–67. Storage cells 50–57 have a common input row enable. A signal applied to row enable simultaneously couples and decouples storage cells 50–57 respectively from switches 40–47. Pixels 60–62 receive a reference voltage $V_{common}$.

FIG. 5 is a timing diagram corresponding to the schematic diagram of FIG. 4. Video information is provided on channels 70–77 respectively for pixels 60–67. At time $T_1$, the row enable signal transitions to a logic state that enables storage cells 50–57 to receive and store video information. Similarly, at time $T_1$, column clock 1 transitions to a logic state that enables switches 40, 42, 44, and 46 to couple video information on channels 70, 72, 74, and 76 respectively to storage cells 50, 52, 54, and 56. At a time $T_2$, column clock 2 transitions to a logic state that enables switches 41, 43, 45, and 47 to couple video information on channels 71, 73, 75, and 77 respectively to storage cells 51, 53, 55, and 57. The difference between the times $T_1$ and $T_2$ is $\Delta T_1$.

At time $T_3$, column clock 1 transitions to a logic state that disables switches 40, 42, 44, and 46. The voltage stored in storage cells 50, 52, 54, and 56 is respectively the voltages on channels 70, 72, 74, and 76 at time $T_3$. Similarly, at time $T_4$, column clock 2 transitions to a logic state that disables switches 41, 43, 45, and 47. The voltage stored in storage cells 51, 53, 55, and 57 is respectively the voltages on channels 71, 73, 75, and 77 at time $T_4$. The difference between the times $T_3$ and $T_4$ is $\Delta T_2$.

In general, a display is driven by a single integrated circuit such that the timing signals for enabling and disabling switches 40–47 derive from the single integrated circuit. As such, column clocks 1 and 2 would be the same signal and thus $\Delta T_1$ and $\Delta T_2$ would be zero or negligible delay due to path or metal interconnect delay differences. In other words, storage cells 50–57 store video information respectively from channels 70–77 at the same time. It has been found that under these conditions video information can be accurately transferred.

In the future, this might not be the case for several reasons. The market is being driven to provide high resolution displays having millions of pixels. These high resolution displays pose several unique problems. First, the size and complexity of the integrated circuit required to drive the display can be significant. Moreover, the number of channels provided by the chip grows in order to meet the fixed timing requirements for writing to millions of pixels. Adding the channels greatly increases the size of the chip because each channel requires a digital to analog converter. The integrated circuit yield can become an issue with larger chip sizes. Second, the cost could be prohibitive. One limiting factor for the current generation of high resolution displays is cost. Every aspect of the display is being analyzed to reduce cost. The market greatly increases in size as the sales price is reduced.

Although it will be discussed in greater detail hereinbelow, it would be beneficial to pursue high channel counts with a methodology that utilize more than one driver chip whereby channels from the more than one integrated would be combined to meet the speed requirements to provide data to a display having large pixel counts. This would decrease chip complexity and allow the use of low cost wafer processes. Referring back to FIG. 4, using more than one driver integrated circuit shows a situation where video information is provided through channels that originate from more than one chip. In the example of FIG. 4, four channels come from a first integrated circuit (channels 70–73) and four channels come from a second integrated circuit (channels 74–77). Referring back to FIG. 5, providing the video information from more than one integrated circuit can produce the situation where the information is coupled to storage cells 50–57 of FIG. 4 at different times and stored at different times. For example, storage cells 50, 52, 54, and 56 are coupled to receive video information a time $\Delta T_1$ before storage cells 51, 53, 55, and 57 of FIG. 4. Similarly, the video information is stored in storage cells 50, 52, 54, and 56 a time $\Delta T_2$ before storage cells 51, 53, 55, and 57 of FIG. 4. Visible display artifacts are generated by providing and storing the information at different times as shown in the example of the timing diagram.

Referring back to FIG. 4, channels 70–73 from the first integrated circuit and channels 74–77 from the second integrated circuit are shown interlaced with one another. In other words, a channel from one integrated circuit provides video information to a switch (switches 40–47) that physically next to a switch that receives video information that originates from the other integrated circuit. It has been found that different groupings still produce visual artifacts if a delay occurs. Also, the problem is not limited to just two integrated circuits providing channels of video information to a display as shown in FIG. 4.

Figure 6:
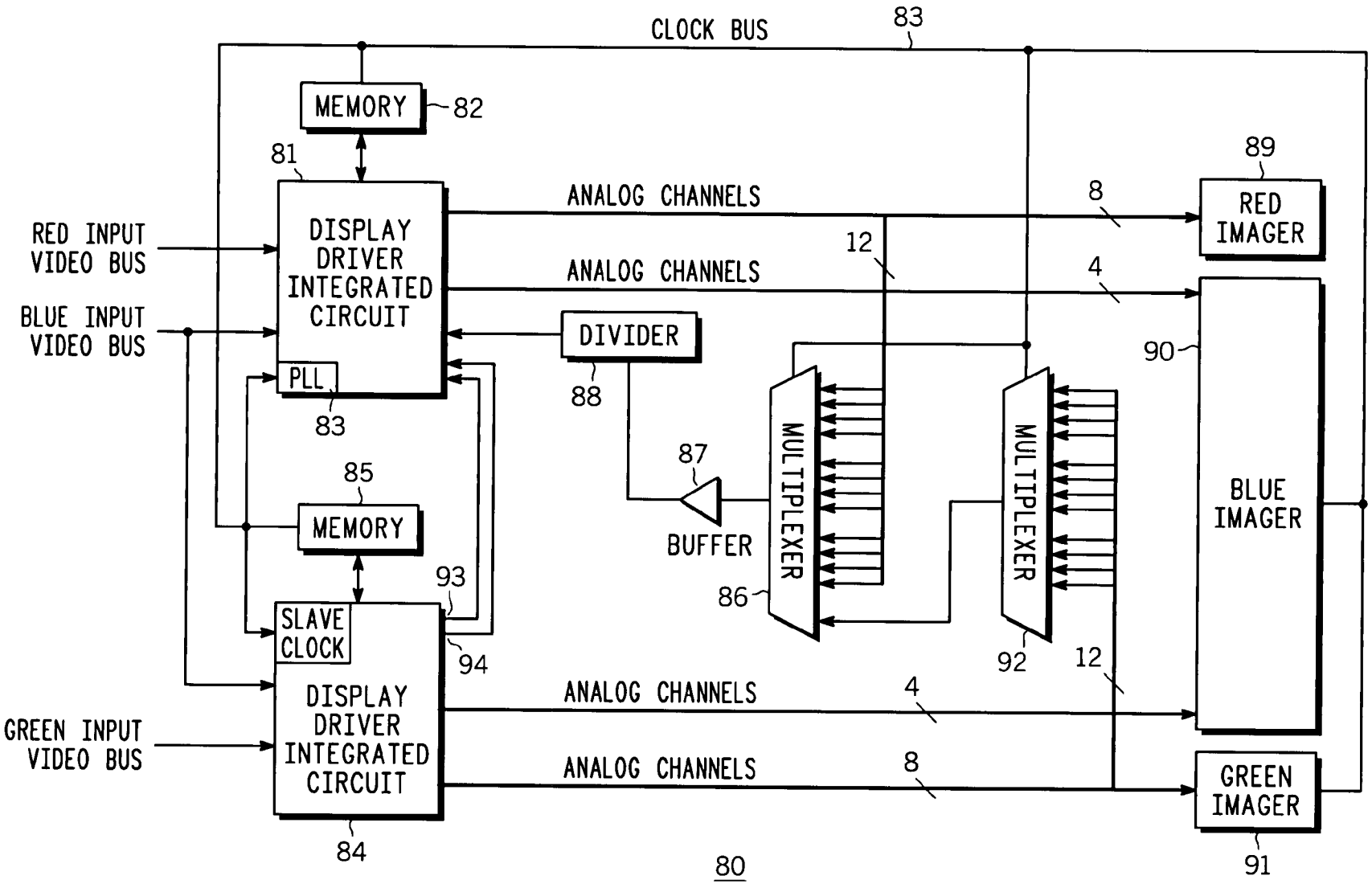
FIG. 6 is a block diagram of a system for driving a display in accordance with the present invention.

FIG. 6 is a block diagram of a system 80 for driving a display in accordance with the present invention. The number of video formats has correspondingly grown with the diversity of display technology and the increase in number of video applications. One parameter of a video format for a pixel based display is the number of columns and rows that comprise the viewing area of the display. For example, a XGA video format provides video information for a display having 1024 columns×768 rows or 768,432 pixels each frame. Similarly, the HDTV-4 video format provides video information for a display having 1920 columns×1080 rows (2,073,600 pixels) each frame. The amount of video information that is provided in a given time period increases with higher column and row counts. Next generation video formats such as QUXGA are for displays having 3200 columns by 2400 rows or 7,680,000 pixels.

For example, a display driver circuit using QUXGA video format provides video information to each of the 7,680,000 pixels (one frame) every $1/60^{th}$ of a second. This amount of video information is doubled when the display driver circuit drives a liquid crystal display requiring frame inversion where a non-inverted frame and an inverted frame of video information (identical images but opposite polarity signal) is provided to the liquid crystal display every $1/120^{th}$ of a second to prevent display degradation. The amount of video information being provided for these next generation video formats is staggering and cannot be achieved efficiently by providing the video information pixel by pixel. One efficient methodology to provide video information for these new video formats utilizing multi-million pixel displays is to design the display driver circuit with multiple output channels where many pixels are being provided video information simultaneously.

The complexity and size of the display driver integrated circuit goes up with the number of output channels for providing video information. For example, a display driver circuit may require on the order of 24–48 output channels to meet the requirements for a multi-million pixel display. A digital to analog converter is needed for each output channel if the display driver circuit provides an analog voltage for each pixel such as would be required in a liquid crystal microdisplay. Similarly, the size of the digital processing section of the display driver circuit would increase correspondingly. Integrating all of these elements on a single integrated circuit would result in a extremely large integrated circuit that could yield very poorly thereby being extremely expensive to produce.

System 80 illustrates a methodology for using more than one display driver integrated circuit for driving a display requiring a large number of channel outputs. Using more than one display driver integrated circuit to drive a multi-million pixel count display is a cost effective approach because lower cost wafer processes and higher yields (lower transistor count/lower complexity circuit) are used. In an embodiment of system 80, three color liquid crystal microdisplays are each receiving video information through 8 channels which corresponds to 8 pixels being driven simultaneously. A total of 24 channels are provided in system 80 requiring two display driver integrated circuits each having the capability of providing 12 channels of video information. It should be noted that this is an example for illustration purposes and more than two display driver integrated circuits could be used but would still have similar problems that could be resolved as described hereinbelow.

System 80 comprises a display driver integrated circuit 81, a memory 82, a display driver integrated circuit 84, and a memory 85. In one embodiment, system 80 drives a red imager 89, a green imager 90, and a green imager 91. The red, green, and blue images respectively generated by red imager 89, green imager 90, and green imager 91, are combined using optics to create a color image. Display driver integrated circuit 81 is coupled to a red input video bus, a blue input video bus, memory 82, and has 12 channel outputs. Eight channel outputs of display driver integrated circuit 81 couple to red imager 89. Four channel outputs of display driver integrated circuit 81 couple to blue imager 90. Memory 82 stores red and blue video information. In an embodiment of system 80, memory 82 allows the video information to be provided to red imager 89 and blue imager 90 in a non-inverted form and an inverted form to prevent degradation of the liquid crystal microdisplays as described hereinabove. Memory 82 provides the video information twice, at twice the speed, such that the non-inverted and inverted forms are provided within the specified time period. The non-inverted and inverted forms produce identical images.

Display driver integrated circuit 84 is coupled to the blue input video bus, a green input video bus, a memory 85, and has 12 channel outputs. Eight channel outputs of display driver integrated circuit 84 couple to green imager 91. Four channel outputs of display driver integrated circuit 84 couple to blue imager 90. Memory 85 stores blue and green video information and performs similar to memory 82 a non-inverted and an inverted form of video information (identical image) to blue imager 90 and green imager 91 to prevent degradation of the liquid crystal microdisplays.

A clock bus 83 provides clock and timing signals to system 80, red imager 89, blue imager 90, and green imager 91. Clock bus 83 includes a master clock from display driver integrated circuit 81 and a slave clock from display driver integrated circuit 84. The master clock controls timings internal to display driver integrated circuit 81, memory 82, red imager 89, and four channels of blue imager 90. Similarly, the slave clock controls timings internal to display driver integrated circuit 84, memory 85, green imager 91, and four channels of blue imager 90. The reason why one clock is called the master clock and the other is called a slave clock will be described in detail later in this description after the problem is outlined further.

It should be noted in this example that blue imager 90 is being driven by both display driver integrated circuits 81 and 84. Red imager 89 is solely driven by display driver integrated circuit 81. Similarly, green imager 91 is solely driven by display driver integrated circuit 84. This configuration is for illustrative purposes to show a situation where video information is being provided to a common element (blue imager 90) from channels of integrated circuits having independent internal timings. More specifically, it highlights the problem when the timing of the video information to a common element of a display differs. In general, a display driver circuit has an internal master clock from which all timings are generated for timing the display driver circuit, external components, and the display. The internal master clock is often generated from a reference source and is typically decoupled from timing on an input video bus.

The clock frequency and timings internally generated within display driver integrated circuit 81 and display driver integrated circuit 84 are very precise and should be equal to one another. What varies is the phase between the master clock signal of display driver integrated circuit 81 and the slave clock signal of display clock driver integrated circuit 84. For example, the master clock of display driver integrated circuit 81 and the slave clock of display driver integrated circuit 84 will have equal frequencies but will be shifted in phase from one another. The phase shift corresponds to a delay where a leading or falling edge of the master clock of display driver integrated circuit 81 occurs before (or after) a leading or falling edge of the slave clock of display driver integrated circuit 84.

Display driver integrated circuit 81 provides video information to 8 pixels simultaneously on red imager 89 and the gating of video information is controlled by the master clock. Similarly, display driver integrated circuit 84 provides video information to 8 pixels simultaneously on green imager 91 and the gating of video information is controlled by the slave clock. In general, the gating of video information to red imager 89 or green imager 91 is performed sequentially where the first row receives video information 8 pixels at a time until the entire row has been written to and then sequencing to each successive row until the entire array of pixels is written to (a frame of video information). In general, video information can be satisfactorily written to red imager 89 and green imager 91 because the gating of video information is derived from a single clock (master or slave). Moreover, the delay or phase shift between the master and slave clocks resulting in the red image on red imager 89 being produced before (or after) the green image on green imager 91 does not produce any visible artifact.

The situation is substantially different for blue imager 90. Four channels of video information are provided by display driver integrated circuit 81 and four channels of video information are provided by display driver integrated circuit 84. In general, a switching network couples the eight channels of video information from display driver integrated circuits 81 and 84 to the appropriate column of the array of pixels which comprises blue imager 90. The switching network sequences the eight channels to provide video information in groups of eight to each pixel of a row of pixels. The master clock signal controls the timing for gating the video information from display driver integrated circuit 81 while the slave clock signal controls the timing for gating the video information from display driver integrated circuit 84. Phase shift between the master and slave clocks will provide video information from the four channels of display driver integrated circuit 81 before (or after) the four channels of display driver integrated circuit 84. Even a small phase shift in the master and slave clock signals will result in an artifact produced on blue imager 90 that is perceptible to the human eye when displayed. It has been proven empirically that the artifact is imperceptible when the phase shift is less than 2 nanoseconds but is a function of the display type and the wafer processing used.

System 80 reduces or eliminates the visual artifact of driving blue imager 90 from two different display driver integrated circuits by incorporating several features that allows the separate integrated circuits to coordinate activities with one another. The term master clock and slave clock for respectively the internal clocks of display driver integrated circuit 81 and display driver integrated circuit 84 indicates that the clocks are related to one another and not operated independently. As mentioned previously, the clock frequency for the master and slave clocks can be generated very accurately and are substantially equal. In an embodiment of system 80, a PLL (Phase Lock Loop) is used to reduce the phase delay between the master and slave clocks. In one embodiment, the delay path for both the master clock and the delay path for the slave clock are made as identical as possible. For example, if the master clock leaves display driver integrated circuit 81 through a buffer and couples back to PLL 83 through a multiplexer circuit a similar path is created for the slave clock to leave display driver integrated circuit 84 through a buffer and couple to PLL 83 through a multiplexer. PLL 83 compares the phase shift between the master clock and the slave clock and generates an error signal that adjusts one of the clock signals to reduce or eliminate the phase shift. PLL 83 continuously monitors and adjusts the master and slave clocks thereby ensuring that the phase shift does exceed 2 nanoseconds under all operating conditions when gating video information to blue imager 90.

Display driver integrated circuit 81 and display driver integrated circuit 84 cannot arbitrarily and independently send out frames of video information. An output 93 of display driver integrated circuit 84 couples to display driver integrated circuit 81 for providing a frame synchronization signal. A similar signal is generated internally to display driver integrated circuit 81. The frame synchronization signals are used to wait until both display driver integrated circuit 81 and display driver integrated circuit 84 are ready to simultaneously process and output frames of video information provided on the red, green, and blue input video buses.

In an embodiment of system 80, red imager 89, blue imager 90, and green imager 91 are liquid crystal microdisplays. Display driver integrated circuits 81 and 84 output video information at twice the rate of the incoming video information to provide a non-inverted and inverted (opposite polarity) video information to prevent liquid crystal microdisplay degradation. It is not desirable for display driver integrated circuit 81 to be providing non-inverted video information to blue imager 90 while display driver integrated circuit 84 is providing inverted (opposite polarity) video information to blue imager 90. An output 94 of display driver integrated circuit 84 couples to display driver integrated circuit 81 to provide a frame polarity signal. Display driver integrated circuit 81 internally generates a signal corresponding to the frame polarity. The frame polarity of display driver integrated circuits 81 and 84 are compared such that the video information output by display driver integrated circuits 81 and 84 are always of the same polarity otherwise adjustments are made to put them in the correct polarity.

In an embodiment of system 80, the digital video information provided at the red, green, and blue input video bus is converted to equivalent analog voltages that are provided to red imager 89, blue imager 90, and green imager 91. In general, the digital to analog converters within display driver integrated circuits 81 and 84 are periodically calibrated to ensure that a digital signal is converted accurately to its corresponding analog voltage. For example, the twelve channels of display driver integrated circuit 81 are coupled to a multiplexer 86. An output of multiplexer 86 couples to a buffer 87 to minimize loading on the channels. An output of buffer 87 couples to a divider 88. Divider 88 scales the input voltage to a smaller value that is provided to display driver integrated circuit 81. Each channel is individually coupled back to display driver integrated circuit 81 for calibration by multiplexer 86. Timing signals on clock bus 83 couple to multiplexer 86 to control when a channel is coupled for calibration. The digital to analog converter corresponding to a channel is compared against reference voltages internal to display driver integrated circuit 81. A search routine is run on the digital to analog converter to compare, adjust, and minimize the voltage error produced by the digital to analog converter to within specification.

A visual artifact could be produced if the digital to analog conversion in display driver integrated circuit 81 differed from display driver integrated circuit 84. More specifically, this will occur when identical digital input signals provided to a digital analog converters of display driver integrated circuits 81 and 84 produce different output voltages. The problem is exacerbated if the difference voltage corresponds to a shift in grey scale that is readily discernible to the human eye. For example, blue imager 90 receives half a frame of video information from display driver integrated circuit 81 and half of the frame from display driver integrated circuit 84. The visual artifact could be highly visible under a condition where identical voltages were supposed to be written to each pixel of blue image 90 but in fact different voltages were written due to digital to analog voltage conversion differences from display driver integrated circuits 81 and 84.

A method to resolve this issue is to calibrate the digital to analog converters of both display driver integrated circuit 81 and display driver integrated circuit 84 substantially equal. In an embodiment of system 80, the twelve channels from display driver integrated circuit 84 are coupled to a multiplexer 92. An output of multiplexer 92 is coupled to an input of multiplexer 86. Clock bus 83 provides timing to control multiplexers 86 and 92 to sequentially couple each of the 12 channels from display driver integrated circuit 84 to display driver integrated circuit 81. Each digital to analog converter of display driver integrated circuit 84 corresponding to a channel output is compared against reference voltages internal to display driver integrated circuit 81. The search routine is run on the digital to analog converters of display driver integrated circuit 84 to compare, adjust, and minimize the voltage error produced by each digital to analog converter. This method calibrates the digital to analog converters from separate integrated circuits using the same voltage references and comparators to minimize error.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for driving a liquid crystal microdisplay comprising the steps of:

coupling at least one channel from a first display driver integrated circuit to the liquid crystal microdisplay;

coupling at least one channel from a second display driver integrated circuit to the liquid crystal microdisplay;

comparing a frame synchronization signal from said first and second display driver integrated circuits;

initiating a transfer of video information through said at least one channel of said first and second display driver integrated circuits to the liquid crystal microdisplay when said frame synchronization signals indicate said first and second display driver integrated circuits are both prepared to transfer video information together to the liquid crystal microdisplay;

comparing a frame polarity signal from said first and second display driver integrated circuits;

preventing said transfer of video information to the liquid crystal microdisplay if a polarity of said video information provided by said first display driver integrated circuit differs from a polarity of said video information provided by said second display driver integrated circuit; and correcting said polarity difference of said video information between said first and second display driver integrated circuits.

2. The method for driving the liquid crystal microdisplay as recited in claim 1 further including the steps of:

comparing a phase shift between internal clock signals of said first and second display driver integrated circuits; and adjusting said internal clock signals of said first and second display driver integrated circuits to reduce said phase shift to prevent visual artifacts on the liquid crystal microdisplay.

3. The method for driving the liquid crystal microdisplay as recited in claim 1 further including the steps of:

providing timing signals to the liquid crystal microdisplay for transferring video information through said at least one channel of said first display driver integrated circuit wherein said timing signals is said internal clock or derived from said internal clock signal of said first display driver integrated circuit; and providing timing signals to the liquid crystal microdisplay for transferring video information through said at least one channel of said second display driver integrated circuit wherein said timing signals is said internal clock signal of said second display driver integrated circuit.

4. The method for driving the liquid crystal microdisplay as recited in claim 3 further including the steps of:

calibrating digital to analog converters of said first display driver integrated circuit periodically; and calibrating digital to analog converters of said second display driver integrated circuit periodically using comparators and reference voltages from said first display driver integrated circuit.

5. A color display system comprising:

a first liquid crystal microdisplay;

a second liquid crystal microdisplay;

a third liquid crystal microdisplay;

a first display driver integrated circuit having a plurality of channel outputs for providing video information wherein said plurality of channel outputs is coupled to at least one of said first, second, or third liquid crystal microdisplay; and a second display driver integrated circuit having a plurality of channel outputs for providing video information wherein said plurality of channel outputs is coupled to at least one of said first, second, or third liquid crystal microdisplays and wherein one of said first, second, or third microdisplays receives video information through channel outputs from both said first and second display driver integrated circuits;

wherein an internal clock of said first display driver integrated circuit is compared to an internal clock of said second display driver integrated circuit and phase adjusted to reduce a delay between said internal clocks of said first and second display driver integrated circuits such that video information is stored substantially at the same time in said first, second, or third microdisplay that receives video information from both said first and second display driver integrated circuits to prevent visual artifacts.

6. The color display system as recited in claim 5 wherein video information is provided to said first and second display driver integrated circuits as digital video information.

7. The color display system as recited in claim 6 further including: a first memory coupled to said first display driver integrated circuit for storing digital video information; and a second memory coupled to said second display driver integrated circuit for storing digital video information.

8. The color display system as recited in claim 7 wherein digital to analog converters in said first and second display driver integrated circuits convert digital video information to analog video information for said first, second, and third liquid crystal microdisplays and wherein said digital to analog converters in said first and second display driver integrated circuits are calibrated periodically using same comparators and voltage references.

9. The color display system as recited in claim 8 wherein said first and second display driver integrated circuits do not transfer video information to said until both are synchronized to do so and wherein said first and second display driver integrated circuits do not transfer information when a polarity of video information differs.

* * * * *